US005746084A

United States Patent [19]

Baur et al.

[11] Patent Number: 5,746,084

[45] Date of Patent: May 5, 1998

[54] DRAWING MECHANISM FOR A PRESS

[75] Inventors: Siegfried Baur, Göppingen; Heinz Horn, Oberhausen; Hartmut Dexling, Göppingen, all of Germany

[73] Assignee: Schuler Pressen GmbH & Co., Germany

[21] Appl. No.: 729,158

[22] Filed: Oct. 11, 1996

[30] Foreign Application Priority Data

Oct. 14, 1995 [DE] Germany ..... 195 38 316.8

[51] Int. Cl.[6] ..... B21D 24/14

[52] U.S. Cl. ..... 72/351; 72/453.13

[58] Field of Search ..... 72/351, 453.13; 91/417 R; 267/119

[56] References Cited

U.S. PATENT DOCUMENTS

| | | | |
|---|---|---|---|
| 2,674,138 | 4/1954 | Mize | 91/417 R |
| 4,499,750 | 2/1985 | Gerber et al. | 72/351 |
| 4,896,594 | 1/1990 | Baur et al. . | |

FOREIGN PATENT DOCUMENTS

| | | |
|---|---|---|
| 0 417 752 A2 | 3/1991 | European Pat. Off. . |
| 0 635 320 A1 | 1/1995 | European Pat. Off. . |
| 0 703 018 A1 | 3/1996 | European Pat. Off. . |
| 36 40 788 A1 | 6/1988 | Germany . |
| 40 28 920 | 3/1991 | Germany . |

*Primary Examiner*—Lowell A. Larson

*Attorney, Agent, or Firm*—Evenson, McKeown, Edwards & Lenahan, P.L.L.C.

[57] ABSTRACT

A drawing mechanism for a press has a drawing slide and a plate holder with a plate held therein. A holding force, which acts against the drawing direction, can be applied to the plate by way of a piston rod which can be displaced in parallel to the drawing direction. A control accelerates the plate holder in the drawing direction before the drawing slide is placed on the plate holder because the plate holder is rapidly acceleratable independently of the drawing slide. A pre-acceleration cylinder is fixed to the press and has a pre-acceleration piston which is operatively connected with the piston rod. The pre-acceleration cylinder has first and second effective surfaces of different sizes which act in opposite directions, and a first and a second pressure chamber.

20 Claims, 1 Drawing Sheet

DRAWING MECHANISM FOR A PRESS

BACKGROUND AND SUMMARY OF THE INVENTION

The present invention relates to a drawing mechanism for a press, and more particularly, to a drawing mechanism having a drawing slide and having a plate holder with a plate held therein. A holding force is applied to the plate by a piston rod which can be displaced in parallel to the drawing direction, which holding force acts against the drawing direction. A control is provided so that, before the drawing slide is placed on the plate holder, the plate holder can be accelerated in the drawing direction. A pre-acceleration cylinder is fixed to the press and has a pre-acceleration piston which is operatively connected with the piston rod with first and second effective surfaces of different sizes which act in opposite directions. The pre-acceleration cylinder has a first and a second pressure chamber, and the first effective surface of the pre-acceleration piston, which acts against the drawing direction, is larger than the second effective surface.

During the working stroke of the drawing slide of a press, first the plate inserted into the tool or into a plate holder is pressed by the drawing die against the plate holder and then, together with the plate holder, is displaced against the holding force applied by the drawing mechanism. The plate held between the plate holder and the drawing die is deformed by the drawing mold of the tool half on the bedplate. In addition to the holding force to be applied by the drawing mechanism, the drawing slide must also overcome the inertia forces of the masses which occur as the result of the acceleration of the movable plate holder masses and drawing mechanism masses at the start of the deformation.

When the top tool of the press strikes the plate holder, a relatively hard impact always occurs with subsequent vibrations which is connected with a correspondingly high noise development. Simultaneously, the plate holder must abruptly be accelerated to the speed of the press slide.

In order to avoid the impact occurring when the top tool of the press strikes the plate holder, a mechanical or hydraulic press is described in DE-OS 40 28 920 which has a drawing device for drawing operations or a drawing stage of a transfer press. The workpiece is braced in a known manner by a plate holder. In order to dampen the impact occurring, particularly the impact noise, when the top tool strikes the plate holder, the movement of the press slide is transmitted to at least one hydraulic cylinder whose hydraulic medium acts by way of a control or in a positively controlled manner upon another pressure cylinder, particularly upon a damping cylinder, which is connected with a die cushion and therefore with the plate holder. The plate holder is thereby accelerated in the drawing direction.

It is a disadvantage of the known mechanical or hydraulic press, however, that the acceleration of the bottom tool of the press takes place as a function of the path of the drawing slide of the press. As a result, it is not possible to freely determine or change the acceleration or the starting point of the acceleration of the bottom tool with the plate holder.

A drawing mechanism for a press of the above-mentioned type is described in DE-OS 36 40 788. A drawing mechanism for a press with a mechanically moved drawing slide and with a plate holder whose holding force acting upon the plate against the drawing direction is applied by way of a piston rod of a pressure cylinder fixed to the press. The piston rod, which is acted upon by a pressure medium, is operatively connected with a pressure piston with an effective surface which can be acted upon in the drawing direction. A control is provided which operates as a function of the slide path and by way of which, before the drawing slide is placed on the plate holder, this plate holder can be pre-accelerated in the drawing direction by the admission of hydraulic fluid to the effective surface. The pressure chamber which is assigned to the effective surface of the pressure piston can, on one hand, be connected with the pressure chamber of a pre-acceleration cylinder and, by way of a follow-up control on the other hand, can be connected with a reservoir for the hydraulic fluid.

A disadvantage of the immediately above-described drawing mechanism is that it also can be controlled as a function of the path of the drawing slide of the press. Consequently, a relatively large amount of time is required to accelerate the bottom tool in the drawing direction. In addition, the arrangement is relatively susceptible to occurring vibrations.

It is therefore an object of the present invention to provide a drawing mechanism for a press such that the bottom tool or the plate holder arranged on the bottom tool, and therefore also the workpiece, can be accelerated rapidly and independently of the path of the drawing slide of the press in the drawing direction.

According to the present invention, this object has been achieved by providing that the first and the second pressure chamber of the pre-acceleration cylinder can be connected with a pressure reservoir and the first pressure chamber can, in addition, be connected with a metering cylinder in which a metering piston is displaceably guided, in parallel to the piston rod, a lead cylinder being provided which is fixed to the press and has a lead piston rod and a lead piston separated from the lead piston rod, and a first pressure medium volume being provided between the lead piston rod and the lead piston which can be discharged from the lead cylinder in a controlled manner, and a second pressure medium volume being displaceable by the lead piston from the lead cylinder.

As the result of the arrangement of the pre-acceleration cylinder, pressure from the pressure reservoir can be permanently applied to the pre-acceleration cylinder because, in the initial position of the press (i.e., before the start of the drawing operation and before the start of the downward movement of the drawing slide), although the first and second effective surface are simultaneously acted upon by a pressure medium, preferably a hydraulic fluid, the pressure reservoir is held in the initial position by the larger first effective surface.

Therefore, during the acceleration of the pre-acceleration piston, pressure medium can very rapidly be supplied into the second pressure chamber and the pre-acceleration piston together with the piston rod can be accelerated correspondingly rapidly in the drawing direction.

The amount of pressure medium displaced in this embodiment from the first pressure chamber by the pre-acceleration piston is supplied to a metering cylinder such that the path of the pre-acceleration piston can be adjusted which the pre-acceleration piston is to cover during the pre-acceleration phase of the drawing operation, thus during the acceleration of the plate holder to the speed of the drawing slide.

The lead cylinder is arranged in parallel to the piston rod in which the lead piston rod and the lead piston are guided in a displaceable manner. Thereby, after the pre-acceleration of the plate holder to the speed of the drawing slide, a pressure is built up which is required for the deformation of the plate situated in the plate holder. The pressure buildup takes place after the displacement of the pressure medium from the lead cylinder by the lead piston and during the controlled discharge of pressure medium displaced by the lead slide from the lead cylinder.

Thus, in the case of the drawing mechanism according to the present invention, the pre-acceleration of the bottom tool of the press or of the plate holder as well as the pressure buildup for the deforming operation take place in two separate and successive stages, or in joint stages. Simultaneously, the control of the corresponding components or assemblies which initiate the acceleration of the pre-acceleration piston can take place independently of the position of the drawing slide so that the start time of the acceleration of the pre-acceleration piston and all components and assemblies directly or indirectly connected therewith can be adjusted.

In an advantageous embodiment of the invention, the pre-acceleration piston is arranged concentrically with respect to the piston rod, whereby the entire drawing mechanism is constructed in an extremely space-saving manner.

In order to provide adjustability of the drawing depth of the drawing mechanism, a stop can be provided on the end of the piston rod facing away from the plate holder. For example, the stop can be constructed as an adjustable stop member.

BRIEF DESCRIPTION OF THE DRAWINGS

These and other objects, features and advantages will become more apparent from the following detailed description of the preferred embodiments when taken in conjunction with the accompanying drawings wherein.

DETAILED DESCRIPTION OF THE DRAWINGS

Figure 1:
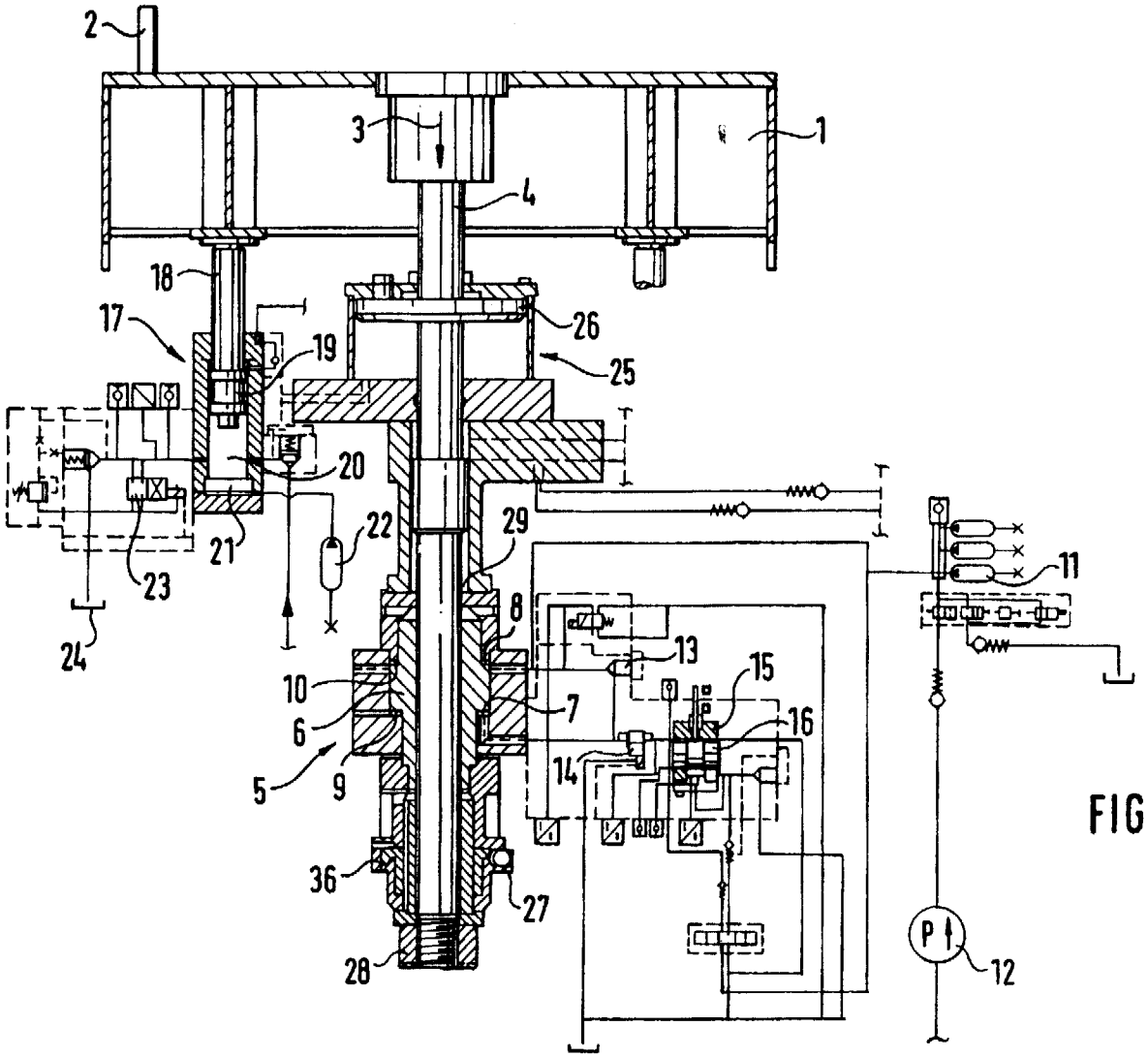
FIG. 1 is a schematic vertical sectional view of the pre-acceleration area of a drawing mechanism according to the present invention.

With reference first to FIG. 1, pressure pins 2, of which for reasons of clarity only one pressure pin 2 is shown, are arranged on a pressure box 1. The bottom tool of the press with the plate holder is mounted on the pressure pins 2 in a known manner. The pressure box 1 is connected with a piston rod 4 which operates parallel to the drawing direction (arrow 3) and which is guided in a known manner.

Concentrically with respect to the piston rod 4, a pre-acceleration cylinder 5 fixed to the press is arranged which has a pre-acceleration piston 6 provided therein and displaceable in the axial direction of the piston rod 4. The pre-acceleration cylinder 5 has a first pressure chamber 7 and a second pressure chamber 8, with a first effective surface 9 being assigned to the first pressure chamber 7 and a second effective surface 10 of the pre-acceleration piston 6 being assigned to the second pressure chamber 8. Of course, it would be within the scope of the present invention to provide the pre-acceleration cylinder 5 also separately from the piston rod 4. Likewise, the first pressure chamber 7 and the second pressure chamber 8 are arranged above one another. However, other arrangements of the pressure chambers 7, 8 with respect to one another are also within the scope of the present invention.

In the initial position of the drawing mechanism illustrated in FIG. 1 (i.e. before the start of the deforming operation), the same pressure from a pressure reservoir 11 of known construction is applied to the first effective surface 9 as well as to the second effective surface 10. In this case, the pressure reservoir 11 can be charged by a pump 12 to a suitable pressure. An appropriate hydraulic fluid or compressed air can be used as the pressure medium.

The pressure contained in the pressure reservoir 11 or the pressure medium contained therein, in the initial position of the drawing mechanism illustrated in FIG. 1, is supplied by way of a cartridge 13 to the first pressure chamber 7 as well as to the second pressure chamber 8, in which case, because of the ring-shaped construction of the first effective surface 9, which is larger than the ring-shaped second effective surface 10, the pre-acceleration piston 6 is held in its illustrated position.

When the cartridge 13 is controlled such that the pressure existing in the pressure reservoir 11 is only still present in the second pressure chamber 8 and, when simultaneously a proportional valve 14, which is arranged between the first pressure chamber 7 and a metering cylinder fixed to the press, is opened up because of the pressure which is lower in the first pressure chamber 7 in comparison to the second pressure chamber 8, the pre-acceleration piston 6 is accelerated in the drawing direction 3. Pressure medium is thereby supplied from the first pressure chamber 7 by way of the proportional valve 14 in a controlled manner to the metering cylinder 15. In the metering cylinder 15, a metering piston 15 is arranged which, as illustrated in FIG. 1, is displaced downwardly by the pressure medium displaced from the first pressure chamber 7.

Because the pre-acceleration cylinder 5 is operatively connected with the piston rod 4 in an appropriate known manner, the piston rod 4 and the pressure box 1 connected therewith with all components mounted thereon, thus also with the plate holder, are accelerated by the pressure medium delivered from the pressure reservoir 11 into the second pressure chamber to a speed which corresponds to the speed of the press drawing slide (not shown).

The metering piston 16 displaceably guided in the metering cylinder 15 limits the pre-acceleration path. That is, as soon as the metering piston 16 is on its stop, the pre-acceleration operation or the pre-acceleration phase is concluded and a further acceleration of the pre-acceleration piston 6 and of the piston rod 4 by way of pressure medium from the pressure reservoir 11 is no longer possible.

The pre-acceleration piston 6 displaces only as much pressure medium from the first pressure chamber 7 as is required in order to accelerate the pressure box 1 with the components mounted thereon to the speed of the drawing slide. This pressure medium amount can be determined by a suitable adjustment of the stops or by a path limiting of the metering piston 16 in the metering cylinder 15.

A lead cylinder 17 is provided parallel to the piston rod 4 and is fixed to the press as well as also connected with the pressure box 1. Of course, several lead cylinders 17 may also be provided which are fixed to the press and are connected with the pressure box 1 within the scope of the present invention. In each of the lead cylinders 17, a lead piston rod 18, which establishes the connection with the pressure box 1, and a lead piston 19, which is provided separately from the lead piston rod 18, are displaceable parallel to the drawing direction 3. A first pressure medium volume 20 is provided between the lead piston rod 18 and the lead piston 19. A second pressure medium volume 21 is provided on the side of the lead piston 19 facing away from the first pressure medium volume 20.

During the pre-acceleration of the pressure box 1, in the view according to FIG. 1, the pressure box 1 is moved downward in the drawing direction 3. As a result, the lead piston rod 18 is also moved into the drawing direction 3, whereby the first pressure medium volume 20 moves downward unchanged together with the lead piston 19. Simultaneously, the second pressure medium volume 21 is pressed into another pressure reservoir 22 by the lead piston 19 which also moves into the drawing direction 3.

After the conclusion of the pre-acceleration phase, i.e. when the metering piston 16 of the metering cylinder 15 is in its intended end position, the lead piston 19 which displaces the second pressure medium volume 21 has also reached its end position. The second pressure medium volume 21 and the volume of the pressure medium existing in the first pressure chamber 7 of the pre-acceleration cylinder 5 thus must each determine the same path of the pressure box 1 or of the piston rod 4. Thus, during the pre-acceleration phase, no pressure rise or buildup takes place in the lead cylinder 17.

At the point in time just after the conclusion of the pre-acceleration phase, the drawing slide of the press is disposed on the plate holder and the plate holder or the pressure box 1 are moved by the drawing slide of the press farther in the drawing direction 3. Now, in order to carry out the deformation of the plate placed in the plate holder, a corresponding pressure must be built up which acts in the opposite direction to the drawing direction 3. This pressure build-up takes place in that the pre-acceleration piston 6 will now stop while the first pressure medium volume 20 by way of another proportional valve 23 is displaced in a controlled manner by the lead piston rod 18 from the lead cylinder 17 and is delivered into a tank 24 for pressure medium. Simultaneously, the piston rod 4 and the pressure box 1 move farther into the drawing direction 3.

By the controlled discharge of the first pressure medium volume 20 from the lead cylinder 17, via a suitable conventional control, a suitable controlled pressure can be adjusted for the deforming operation.

If, after the conclusion of the deforming operation (i.e. when the drawing slide of the press is in its lower dead center), the pressure box 1 is to be moved upward again, a pneumatic cylinder 25 which interacts with the piston rod 4 and whose piston 26 was moved during the deforming operation into the drawing direction 3, is acted upon with compressed air in the appropriate manner. The piston 26 of the pneumatic cylinder 25 moves against the drawing direction 3 and, in the process of movement, brings the piston rod 4 and the pressure box 1 with all components mounted thereon back into its initial position. A suitable device or arrangement for controlling the pneumatic cylinder 25 is known and therefore does not have to be described here in detail and by itself does not form part of the present invention.

Simultaneously, the cartridge 13 is controlled such that the same pressure exists again in the first pressure chamber 7 and in the second pressure chamber 8. Because of the larger first effective surface 9, the pre-acceleration piston 6 is moved against the drawing direction into the initial position illustrated in FIG. 1. The pre-acceleration piston 6 is therefore moved independently of the piston rod 4 and of the pressure box 1 back into its initial position.

Also the metering piston 16 is moved in an appropriate manner back into its starting position, and the pressure medium volume contained in the metering cylinder 15 is again delivered into the first pressure chamber 7. The first pressure medium volume 20 is again filled to a preadjusted value. From the additional pressure reservoir 22, pressure medium is delivered into the second pressure medium volume 21, whereby the lead piston 19 also moves against the drawing direction 3 into its initial position. Thus, the initial position of the drawing mechanism illustrated in FIG. 1 is restored, after which a new deforming operation can be initiated.

A stop member 36 is provided on the end of the piston rod 4 facing away from the pressure box 1 and can be adjusted by a worm gear 27. The stop member 36 interacts with a stop nut 28 so that the drawing depth of the drawing mechanism can be adjusted in a simple manner by the stop member 36 which is adjustable parallel to the drawing direction 3. The stop member 36 is displaced in the drawing direction by the pre-acceleration piston 6 during the pre-acceleration phase and, in the displacement process, presses on the stop nut 28 firmly connected with the piston rod 4, whereby the pressure box 1 is accelerated.

The stop member 36 and the stop nut 28 limits the movement of the pressure box 1 or of the piston rod 4 connected with the pressure box 1 against the drawing direction 3. Furthermore, the piston rod 4 is provided with a damping device 29 which, after the deforming operation, dampingly brings the piston rod 4 with all components connected therewith, particularly with the pressure box 1, into the initial position illustrated in FIG. 1. It is, of course, left up to the person skilled in the art to also provide the metering cylinder 15 with a suitable damping device in order to avoid an abrupt braking of the metering piston 16 when its end position is reached.

Thus, by way of the described drawing mechanism, a pre-acceleration of the pressure box 1 with the bottom tool of the press mounted thereon and with the plate holder mounted thereon can be achieved rapidly and independently of the path or of the position of the drawing slide of the press. The controlling of the described components or assemblies takes place in a known manner by means of a control which is not shown.

Figure 2:
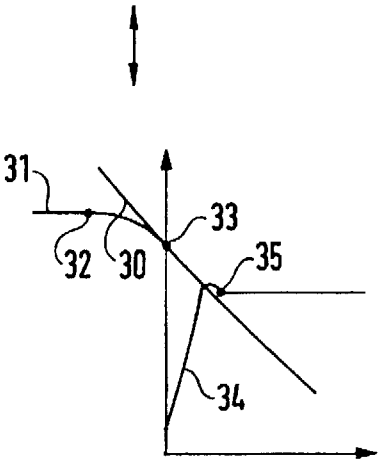
FIG. 2 is a diagram for representing the movement sequences of the drawing slide and the plate holder during the pre-acceleration phase.

In FIG. 2, the stroke of the drawing slide is marked over the angle of rotation of the drive and a cutout represented by a curve 30 for a possible movement of the drawing slide of a press as well as a curve 31 of a possible movement of the pressure box 1 and therefore also of the plate holder. During the working stroke of the drawing slide, the plate holder is accelerated starting from a freely definable or dynamic point 32 which is not a function of the path of the drawing slide of the press. The acceleration or pre-acceleration of the plate holder or the pressure box 1 takes place to a point 33 at which the speed of the pressure box 1 corresponds to the speed of the drawing slide. Starting at point 33, the pressure buildup takes place in the lead cylinder 17 (see FIG. 1) and the pressure box 1 is moved at the speed of the drawing slide farther into the drawing direction 3.

FIG. 2 also illustrates another curve 34 which shows the pressure buildup for the deforming operation after the conclusion of the pre-acceleration phase over the angle of rotation. Curve 34 shows that the pressure buildup starts at point 33, at which the pre-acceleration of the pressure box 1 is concluded, and extends to another point 35 at which, in a controlled manner, the first pressure medium volume 20 is discharged from the lead cylinder 17. Starting at this time, the pressure in the lead cylinder 17 is controlled until the conclusion of the deformation operation.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Drawing mechanism for a press, comprising a drawing slide;

a plate holder with a plate held therein, with a holding force being applied to the plate by a piston rod displacable in parallel to a drawing direction, which holding force acts against the drawing direction; and a control arrangement operatively associated with the plate holder such that, before the drawing slide is placed on the plate holder, the plate holder being accelerated in the drawing direction, the control arrangement comprises a pre-acceleration cylinder fixed to the press and having a pre-acceleration piston operatively connected with the piston rod, the pre-acceleration piston having first and second effective surfaces of different sizes acting in opposite directions, the pre-acceleration cylinder further having a first and a second pressure chamber, and the first effective surface of the pre-acceleration piston acts against the drawing direction and is larger than the second effective surface;

wherein the first and the second pressure chambers are connectable with a pressure reservoir, and the first pressure chamber is connectable with a metering cylinder having a displaceably guided metering piston for movement alone an axis parallel to an axis of movement of the piston rod, and a lead cylinder is fixed to the press and has a lead piston rod having an axis of movement spaced from the axis of movement of the piston rod and a lead piston separate from the lead piston rod, with a first pressure medium volume being arranged between the lead piston rod and the lead piston which is controllably dischargeable from the lead cylinder, and a second pressure medium volume being displaceable by the lead piston from the lead cylinder.

2. The drawing mechanism according to claim 1, wherein the pre-acceleration piston is concentric with the piston rod.

3. The drawing mechanism according to claim 1, wherein a stop is arranged at an end of the piston rod facing away from the plate holder for limiting drawing depth.

4. The drawing mechanism according to claim 3, wherein the pre-acceleration piston is concentric with the piston rod.

5. The drawing mechanism according to claim 3, wherein the stop is adjustably arranged at the end of the piston rod.

6. The drawing mechanism according to claim 5, wherein the pre-acceleration piston is concentric with the piston rod.

7. The drawing mechanism according to claim 1, wherein the second pressure medium volume is configured to be deliverable into another pressure reservoir.

8. The drawing mechanism according to claim 7, wherein the pre-acceleration piston is concentric with the piston rod.

9. The drawing mechanism according to claim 8, wherein a stop is arranged at an end of the piston rod facing away from the plate holder for limiting drawing depth.

10. The drawing mechanism according to claim 1, wherein a proportional valve is arranged between the first pressure chamber in the pre-acceleration cylinder and the metering cylinder.

11. The drawing mechanism according to claim 10, wherein the pre-acceleration piston is concentric with the piston rod.

12. The drawing mechanism according to claim 11, wherein a stop is arranged at an end of the piston rod facing away from the plate holder for limiting drawing depth.

13. The drawing mechanism according to claim 12, wherein the stop is adjustably arranged at the end of the piston rod.

14. The drawing mechanism according to claim 13, wherein the second pressure medium volume is configured to be deliverable into another pressure reservoir.

15. The drawing mechanism according to claim 1, wherein a second proportional valve is provided to discharge the first pressure medium volume.

16. The drawing mechanism according to claim 15, wherein the pre-acceleration piston is concentric with the piston rod.

17. The drawing mechanism according to claim 16, wherein a stop is arranged at an end of the piston rod facing away from the plate holder for limiting drawing depth.

18. The drawing mechanism according to claim 17, wherein the stop is adjustably arranged at the end of the piston rod.

19. The drawing mechanism according to claim 18, wherein the second pressure medium volume is configured to be deliverable into another pressure reservoir.

20. The drawing mechanism according to claim 19, wherein a proportional valve is arranged between the first pressure chamber in the pre-acceleration cylinder and the metering cylinder.

* * * * *